US008217340B2

(12) United States Patent
Yoshimura et al.

(10) Patent No.: US 8,217,340 B2
(45) Date of Patent: Jul. 10, 2012

(54) MASS SPECTROMETRY SUBSTRATE AND MASS SPECTROMETRY METHOD

(75) Inventors: Kimihiro Yoshimura, Yokohama (JP); Manabu Komatsu, Kawasaki (JP); Hiroyuki Hashimoto, Yokohama (JP); Yohei Murayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 344 days.

(21) Appl. No.: 12/427,583

(22) Filed: Apr. 21, 2009

(65) Prior Publication Data

US 2009/0266982 A1 Oct. 29, 2009

(30) Foreign Application Priority Data

Apr. 24, 2008 (JP) ..... 2008-114483

(51) Int. Cl.
*H01J 49/26* (2006.01)

(52) U.S. Cl. ..... 250/288; 250/281; 252/408.1; 252/600; 436/173; 436/174; 436/181; 73/863

(58) Field of Classification Search ..... 250/281, 250/282, 288; 252/408.1, 600; 436/173, 436/174, 181; 73/23.37, 23.41, 863
See application file for complete search history.

(56) References Cited

U.S. PATENT DOCUMENTS

2001/0050351 A1* 12/2001 Saito et al. ..... 252/182.15
2003/0106997 A1* 6/2003 Beecher et al. ..... 250/288
2003/0138823 A1* 7/2003 Brock et al. ..... 435/6
2006/0024723 A1* 2/2006 Hussa et al. ..... 435/6
2006/0118711 A1 6/2006 Murayama

FOREIGN PATENT DOCUMENTS

JP 2006-153493 A 6/2006
JP 2006-170857 A 6/2006
JP 2006-201042 A 8/2006

* cited by examiner

*Primary Examiner* — David A Vanore
*Assistant Examiner* — Nicole Ippolito
(74) *Attorney, Agent, or Firm* — Canon U.S.A., Inc., IP Division

(57) ABSTRACT

A mass spectrometry method that makes it possible to perform high-sensitivity detection of a desorbed/ionized object substance to be measured in mass spectrometry in which the object substance to be measured is desorbed and ionized. The method includes placing at least an ionizing agent having two or more functional groups represented by Formula (1) below in a molecule:

$$—(CF_2)COOH \quad (1)$$

wherein the ionizing agent has a boiling point of equal to or higher than 150° C. and an object molecule to be measured on a substrate and irradiating the ionizing agent and the object molecule to be measured with a primary beam selected from ions, neutral particles, electrons, and a laser beam.

15 Claims, 4 Drawing Sheets

MASS SPECTROMETRY SUBSTRATE AND MASS SPECTROMETRY METHOD

BACKGROUND OF THE INVENTION

1. Field of the Invention

The present invention relates to a substrate for use in mass spectrometry including a process of desorbing and ionizing an object substance to be measured by using a primary beam selected from ions, neutral particles, electrons, and a laser beam, and also to a mass spectrometry method.

Furthermore, the present invention also relates to imaging detection of constituents of each kind constituting a measurement object, in particular organic substances such as proteins, with a mass spectrometry device including a process of desorbing and ionizing an object substance to be measured by using a primary beam selected from ions, neutral particles, electrons, and a laser beam.

2. Description of the Related Art

In a mass spectrometry device, an object substance to be measured is ionized by some method, an electric field or a magnetic field is applied to the ionized substance, separation is performed according to a mass/charge ratio (m/z), and then the measurement object is qualitatively and quantitatively analyzed from an electrically detected mass spectrum. In this case, a variety of ionization methods are used, such as electron spray ionization (ESI), electron bombardment ionization (EI), chemical ionization (CI), fast atom bombardment (FAB), field desorption (FD), laser desorption ionization (LDI), matrix assisted laser desorption ionization (MALDI), and secondary ion mass spectrometry (SIMS) in which irradiation is performed with elemental ions, element cluster ions, and molecular ions. For example, in laser ionization mass spectrometer, a mass spectrum and the like can be measured by irradiating and ionizing a sample with a pulsed laser beam and introducing the ions into an analytical unit, for example, of a time of flight type.

To enable mass spectrometry of the object substance to be measured, a state has to be formed in which the substance contained in the analyte is an independent molecular unit, and this independent molecular unit has to have a positive or negative electric charge. Among the above-described mass spectrometry methods, the MALDI method has found especially broad application in a variety of fields in recent years because this method makes it possible to measure molecules with a high molecular weight such as polymer materials and proteins that have been heretofore difficult to measure. This is apparently because the MALDI method makes it possible to satisfy the two above-described conditions enabling mass spectrometry since the method uses a matrix that weakens interaction between the molecules to be measured and, therefore, increases the extraction efficiency of components to be measured as independent molecular units and also since the matrix itself can perform ionization of the molecules that are the measurement object by a reaction induced by laser irradiation.

Examples of the substance to be measured that is provided with an electric charge include radical cations obtained by pulling electrons off the substance to be measured, radical anions obtained by donating electrons to the substance to be measured, cations obtained by donating a proton or a cation of an alkali metal or silver to the substance to be measured, and anions obtained by donating an anion of a halogen or the like or by deprotonizing. In particular, in biomolecules such as proteins, a large number of polar groups are present and mass spectrometry can be conducted with a comparatively high sensitivity by cationization based on addition of protons.

In the field of mass spectrometry using laser irradiation, porous silicon has been used in recent years instead of a matrix, thereby making it possible to perform mass spectrometry with a comparatively good sensitivity and in a state in which peaks of impurities derived from the matrix are small, and this approach attracted much attention. Although the operation effect of mass spectrometry using a porous substrate is unclear, apparently because the specific surface area is larger than that of a flat substrate, the number of adsorption points of the analyte molecules is large and the degree of aggregation of these molecules on the substrate is decreased, thereby increasing the ratio of desorption in single molecular units by laser irradiation.

Furthermore, imaging technology using mass spectrometry has also attracted much attention in recent years. This is because a strong demand arose for specifying the location of developed proteins or impurities that adhered to the surface, for example, in biological tissues such as tumor cells and electronic materials such as semiconductor wafers.

In imaging technology based on mass spectrometry, a process of desorbing and ionizing the analyte molecules is carried out by a device using irradiation with a focused ion beam or laser beam. In particular, in SIMS, molecules that have adhered to the surface can be desorbed with a very high efficiency by irradiation with gallium ions or gold ions. As for the molecules with a comparatively high molecular weight that are difficult to desorb, because such molecules can be fragmented during irradiation with gallium ions or gold ions, it is still possible to obtain information, even though partial, that relates to the molecules that are the measurement object.

In mass spectrometry of such a type that uses irradiation with laser or with gallium ions or gold ions, the desorption of molecules can also proceed in a state of neutral molecules or neutral radicals, rather than only in a state of ions. Detection in mass spectrometers is performed on the basis of charge information of molecules that are desorbed in monomolecular units. The resultant problem is that neutral molecules or radicals cannot be detected even when the desorbed number thereof is large.

The problem associated with ionization efficiency of the molecules to be measured becomes particularly serious in mass spectrometry in which irradiation is performed with a laser or gadolinium ions, without using a matrix.

To resolve this problem, examples of Japanese Patent Laid-open No. 2006-201042 discloses a method for adding sodium iodide to the molecules to be measured and detecting the molecules as adducts of sodium ions. Furthermore, US Patent Application Publication No. 2006/0118711 (corresponding to Japanese Patent Laid-open No. 2006-153493) discloses a method for increasing ionization efficiency by adding an acid such as trifluoroacetic acid, hydrochloric acid, nitric acid, and hydrofluoric acid.

However, although the addition of a metal salt such as an alkali metal salt sometimes makes it possible to ionize the molecules that are the measurement object with good efficiency, such a salt is also known to inhibit ionization, as disclosed in Japanese Patent Laid-open No. 2006-170857, and is not necessarily effective in increasing the ionization efficiency. Furthermore, adding an acid such as trifluoroacetic acid or hydrochloric acid can be effective because the acid has a proton donating capacity and produces no ionization inhibiting effect like metal ions. However, these acids have high volatility. In particular, because of high-vacuum state inside a mass spectrometer, these volatile acids can be volatilized during measurement and the proton donating capacity thereof can change. In measurements performed in a plurality of locations for imaging, the concentration of acid differs depending on the measurement site or measurement order, and this difference can change the ionization efficiency. By contrast, sulfuric acid is known as a non-volatile acid, but where a solvent such as water contained in the measurement sample evaporates and the concentration of sulfuric acid increases, there is a risk of modifying the molecules that are the measurement object by a strong oxidizing or dehydrating reaction of sulfuric acid.

SUMMARY OF THE INVENTION

As described hereinabove, with the conventional methods, the problem arising in mass spectrometry in which an object substance to be measured is desorbed and ionized by using a primary beam selected from ions, neutral particles, electrons, and a laser beam is that the molecules that are the measurement object are difficult to ionize with high efficiency over a long period or uniformly in measurement locations.

The present invention has been created with consideration for the above-described background art, and the present invention provides a substrate for mass spectrometry and a mass spectrometry method that make it possible to perform high-sensitivity detection of a desorbed/ionized substance that is the measurement object in mass spectrometry in which the substance that is the measurement object is desorbed and ionized.

A substrate for mass spectrometry that resolves the above-described problems is a substrate for use in mass spectrometry including a process of desorbing and ionizing an object substance to be measured by using a primary beam selected from ions, neutral particles, electrons, and a laser beam, wherein the substrate includes an ionizing agent having two or more functional groups represented by Formula (1) below in a molecule and having a boiling point of equal to or higher than 150° C.:

$$—(CF_2)COOH \quad (1)$$

A mass spectrometry method that resolves the above-described problems includes the steps of placing at least an ionizing agent having two or more functional groups represented by Formula (1) in a molecule and having a boiling point of equal to or higher than 150° C. and a molecule that is a measurement object on a substrate, and irradiating the ionizing agent and the molecule that is a measurement object with a primary beam selected from ions, neutral particles, electrons, and a laser beam.

Furthermore, a mass spectrometry method that resolves the above-described problems is a mass spectrometry method in which information relating to a distribution state of the molecule that is a measurement object is obtained based on mass information acquired by changing an irradiation position of a primary beam selected from ions, neutral particles, electrons, and a laser beam on the ionizing agent and the molecule that is an analyte, wherein the above-described substrate for mass spectrometry is used.

In accordance with the present invention, it is possible to provide a substrate for mass spectrometry and a mass spectrometry method that make it possible to perform high-sensitivity detection of a desorbed/ionized substance that is the analyte in mass spectrometry in which the substance that is the measurement object is desorbed and ionized.

Furthermore, the present invention can provide a substrate for mass spectrometry that makes it possible to perform high-sensitivity detection of a compound with a high molecular weight by desorption/ionization and also effectively inhibit fragmentation so as to create substantially no obstacles to analysis in a low-molecular region in mass spectrometry using desorption and ionization by laser beam irradiation.

Further features of the present invention will become apparent from the following description of exemplary embodiments with reference to the attached drawings.

DESCRIPTION OF THE EMBODIMENTS

Figure 1:
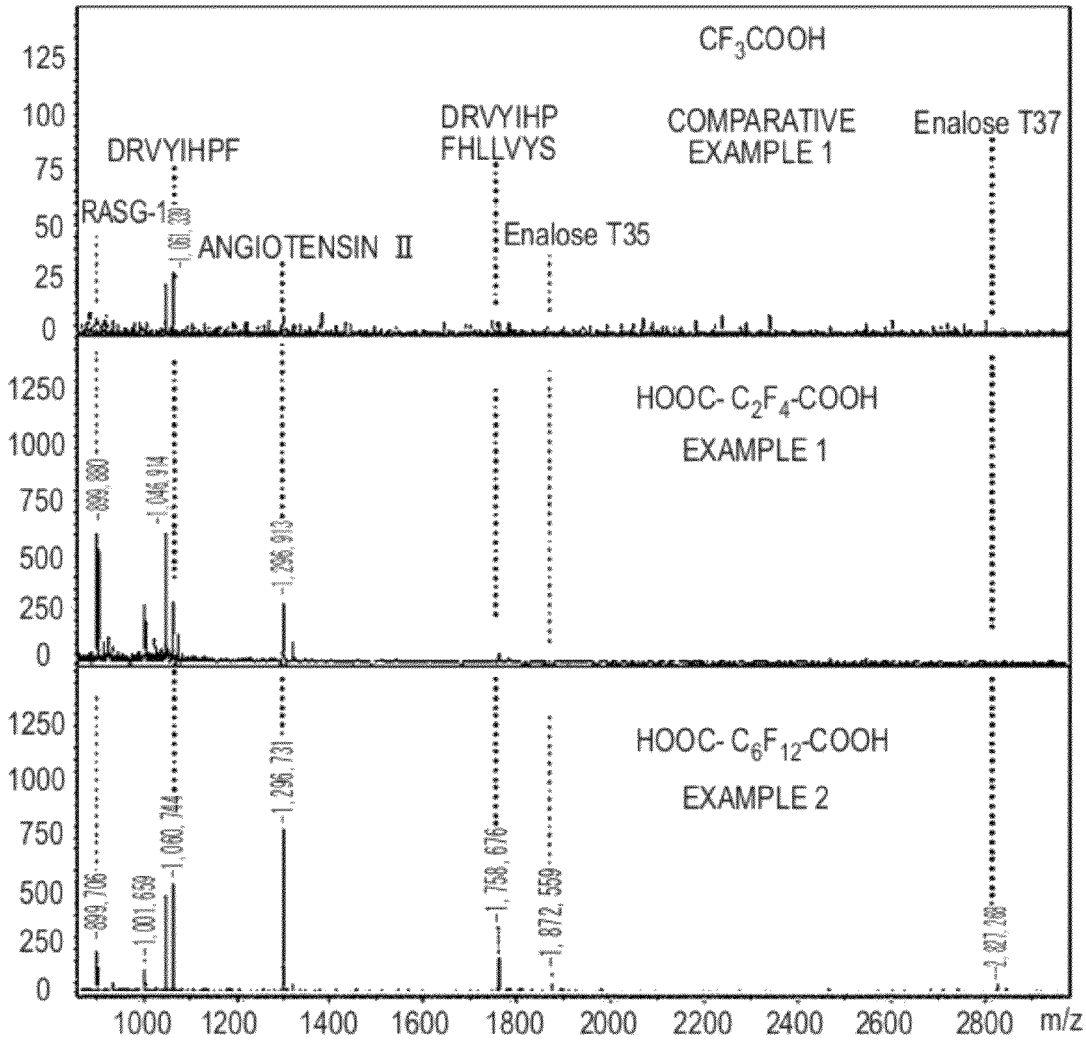
FIG. 1 illustrates mass spectrometry spectra of Examples 1 and 2 and Comparative Example 1.

The present invention will be described below in greater detail.

The substrate for mass spectrometry in accordance with the present invention is a substrate for use in mass spectrometry including a process of desorbing and ionizing an object substance to be measured by using a primary beam selected from ions, neutral particles, electrons, and a laser beam, wherein the substrate includes an ionizing agent having two or more functional groups represented by Formula (1) below in a molecule and having a boiling point of equal to or higher than 150° C.:

$$—(CF_2)COOH \quad (1)$$

The ionizing agent does not absorb ultraviolet radiation with a wavelength equal to or greater than 330 nm and equal to or less than 370 nm may be used.

The ionizing agent may be a compound represented by General Formula (2) below:

$$HOOC—(CF_2)n\text{-}COOH \quad (2)$$

where n is integer equal to or greater than 2 and equal to or less than 7.

The substrate for mass spectrometry may be formed from a material selected from gold, platinum, stainless steel, titanium oxide, zinc oxide, tin oxide, and ITO.

The mass spectrometry method in accordance with the present invention includes the steps of: placing at least an ionizing agent having two or more functional groups represented by Formula (1) in a molecule and having a boiling point of equal to or higher than 150° C. and a analyte molecule on a substrate, and irradiating the ionizing agent and the molecule that is a measurement object with a primary beam selected from ions, neutral particles, electrons, and a laser beam.

An ionizing agent may be coated on the substrate and a solution including an analyte molecule may be coated on the ionizing agent.

A solution including an ionizing agent and a molecule that is a measurement object may be coated on the substrate.

Information relating to a distribution state of an object substance to be measured may be obtained based on mass information acquired by changing an irradiation position of a primary beam selected from ions, neutral particles, electrons, and a laser beam on the ionizing agent and the molecule that is a measurement object.

The mass spectrometry method in accordance with the present invention is a mass spectrometry method in which information relating to a distribution state of an object substance to be measured is obtained based on mass information acquired by changing an irradiation location of a primary beam selected from ions, neutral particles, electrons, and a laser beam, wherein the above-described substrate for mass spectrometry is used.

The results of comprehensive research conducted by the inventors demonstrated that where a substrate for mass spectrometry is used that has an ionizing agent having two or more functional groups represented by Formula (1) in a molecule and having a boiling point of equal to or higher than 150° C., an analyte molecule is protonized with good efficiency and also constant efficiency over a long period.

Biological substances such as proteins and peptides have a structure in which a plurality of amino acids are bounded by amido bonds, and in ionization thereof a comparatively large number of cites to which protons have been donated are present. As a result, detection in a mass spectrometer can be performed by ionization caused by protonization. However, the easiness of protonization differs among the substances and is not constant. In an aqueous solution of a protein or a peptide, there is a hydrogen ion concentration called an isoelectric point, an electric charge of the protein or peptide that is a solute becomes zero in the vicinity of the isoelectric point, and in a state under this isoelectric point, the solute can be protonized. Therefore, a compound with a certain high proton donating ability may be used for protonizing the target protein or peptide.

As an example of using compounds with a high proton donating ability in mass spectrometry, for example, the aforementioned Japanese Patent Laid-open No. 2006-153493 discloses using an acid such as trifluoroacetic acid, hydrochloric acid, nitric acid, hydrofluoric acid, acetic acid, and formic acid and describes a certain effect obtained. However, among the acids listed therein, organic acids other than trifluoroacetic acid are not that strong. A carboxyl group is a portion that acts as an acid, but this functional group is also contained in an amino group. In particular, in asparagic acid and the like, even though one carboxyl group is used in an amido bond due to a peptide bond, there is yet another carboxylic group. Therefore, the isoelectric point becomes low and there is a possibility that sufficient proton donating ability will not be obtained by simple addition of organic acid in protonization of a peptide or protein with a large number of such asparagic acid units. Trifluoroacetic acid has a carbon atom bonded to a carboxyl group and fluorine atoms with strong electron attraction ability. Therefore this acid is stronger than acetic acid or formic acid, and proton donating ability can be increased. However, gas pressure in the ionization chamber in MALDI-TOF, MS, or TOF-SIMS typically corresponds to a high-vacuum state in order to prevent the generated ion species from being eliminated by collisions with the surrounding gas molecules. It can be predicted that in such a high-vacuum environment of the ionization chamber, an organic acid with a low molecular weight such as forming acid, acetic acid, and nitric acid will be volatilized and efficacy thereof as a proton donor will decrease. Furthermore, an inorganic acid such as hydrochloric acid and hydrofluoric acid is in an aqueous solution state, but it can be assumed that after water has evaporated, the acid will be similarly volatilized and efficacy thereof as a proton donor will decrease. As an aqueous solution, nitric acid has a boiling point of about 123° C. due to the formation of an azeotropic mixture. However, the degree of vacuum in a mass spectrometer is high and with acids obtained by dissolving an acid in a gaseous state, it is difficult to retain a sufficient amount of acid under vacuum conditions of the mass spectrometer and an action of protonizing the object substance to be measured is difficult to maintain. Furthermore, although sulfuric acid is not an evaporable acid, it has a strong oxidizing ability and high viscosity. Even when a dilute solution of sulfuric acid is used, the concentration of sulfuric acid rises with evaporation of water. When an organic substance is in contact with concentrated sulfuric acid, it can be assumed that oxygen atoms and hydrogen atoms present in an organic molecule are taken away by dehydration reaction of the sulfuric acid and intensive modification such as carbonizing is induced, and even nonvolatile acids are not necessarily suitable for use in mass spectrometers under high-vacuum conditions. Furthermore, a problem associated with nitric acid is that although boiling point thereof is high to a certain degree, a modification reaction such as nitration is induced by contact with an organic substance.

A variety of compounds demonstrating a protonizing effect were studied. The results obtained demonstrated that in order to obtain a protonizing ability stronger than that of a carboxyl group, which is a usual organic acid, a structure has to be obtained in which a fluorine atom is bonded to carbon bonded to a carboxyl group. Furthermore, it was taken into account that to demonstrate efficacy under high-vacuum conditions of a mass spectrometer, the molecule should not be evaporable or volatile. In particular, in the case of compounds with a boiling point equal to or higher than 150° C., the effect can be maintained without immediate volatilization or evaporation even under high-vacuum conditions of a mass spectrometer.

Furthermore, water is most often used as a solvent in analysis of biosamples such as proteins and peptides. Therefore, it was determined that an aqueous solution system is suitable as a field in which a protein or peptide as a molecule that is a measurement object is brought into contact with a proton donor and that the proton donor also has to be soluble in water. Typically, if a molecular weight increases, a melting point or boiling point rises, and the ability to remain under high-vacuum conditions rises. However, it was found that, for example, if a carbon chain having a fluorine atom is employed to raise a melting point and a boiling point, while maintaining high proton donating ability, although the melting point and boiling point rise, solubility in water decreases to an extreme and the compound cannot be used as a proton donor for a protein or peptide. Furthermore, the adverse effect of introducing a unit having an aromatic ring to raise a melting point or a boiling point is that absorption of ultraviolet radiation rises, and in an ionization method of a laser irradiation type, the proton-donating agent absorbs the irradiated laser beam, thereby inhibiting desorption and ionization of the object substance to be measured, whereas in a measurement method using a matrix molecule, crystallinity of matrix is inhibited.

Comprehensive research of proton donating agents were conducted and the results obtained demonstrated that a compound having two or more functional groups represented by Formula (1) in a molecule maintains proton donating ability and solubility in water, while having a high boiling point, and is advantageously suitable as an ionizing agent for mass spectrometry. In particular, among such ionizing agents, molecules of a non-aromatic system have substantially no absorption in an ultraviolet region and absorb no irradiation energy as ionizing agents in mass spectrometry using laser irradiation, thereby enabling effective absorption of irradiation energy by a matrix or a substrate. As a result, the adsorption of the molecule to be measured is not inhibited.

The number of functional groups represented by Formula (1) above that are present in one molecule of the ionizing agent in accordance with the present invention may be two or more, and from the standpoint of handleability, two or three functional groups may be used.

The structure of the ionizing agent molecule other than the portion represented by Formula (1) above is not particularly limited, provided that the boiling point of the molecule can be equal to or higher than 150° C. However, in order to avoid strong absorption in the infrared region with a wavelength of equal to or greater than 330 nm and equal to or smaller than 370 nm, a nonaromatic unit and a unit that does not decrease a proton donating ability of the molecule as a whole may be used. In particular, an alkylene unit substituted with a fluorine atom can be advantageously used because a boiling point can be increased, while maintaining the proton donating ability and without increasing the absorption in the infrared region with a wavelength of equal to or greater than 330 nm and equal to or smaller than 370 nm, and a perfluorodicarboxylic acid in which a unit represented by Formula (1) above is bonded to both ends of a perfluoroalkylene chain can be used especially advantageously. In this case, where the perfluoroalkylene chain length is too long, it can be expected that decrease in solubility in water will be more significant than effect on boiling point or proton donating ability. Accordingly, the number of carbon atoms in the perfluoroalkylene chain linking the units represented by Formula (1) above may be equal to or greater than 2 and equal to or smaller than 5.

For these reasons, a dicarboxylic acid represented by General Formula (2) may be used as the ionizing agent where n is integer equal to or greater than 2 and equal to or less than 7, preferably equal to or greater than 2 and equal to or less than 5.

Specific structural formulas of ionizing agents that can be used in accordance with the present invention are presented hereinbelow in TABLE I by way of examples, but the present invention is not limited to these exemplary compounds.

TABLE I

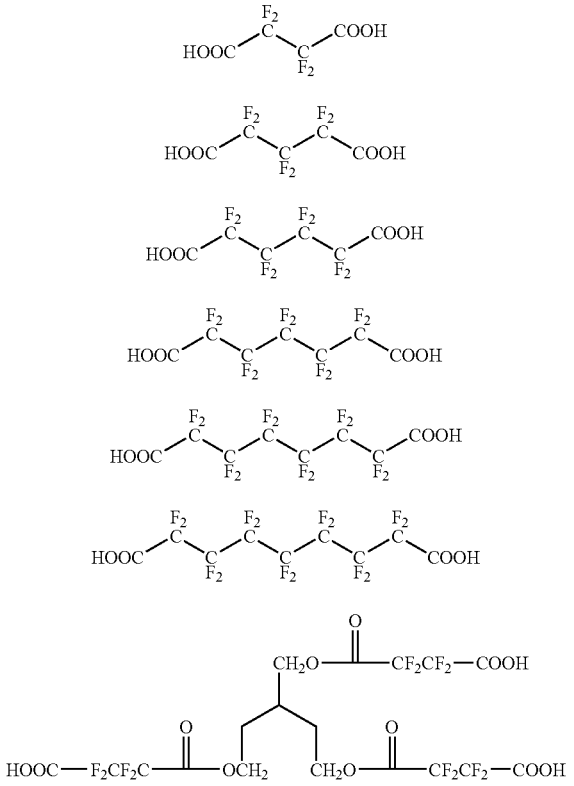

TABLE I-continued

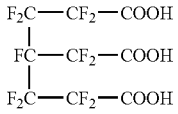

In accordance with the present invention, the following three methods for using the ionizing agent can be considered: (1) the ionizing agent is coated on a sample substrate for mass spectrometry, and then a reagent to be used in mass spectrometry, such as an analyte or a matrix is coated; (2) a solution obtained by simultaneously mixing the ionizing agent in accordance with the present invention with an analyte or a matrix is coated on a substrate; and (3) an analyte or a matrix is coated on a substrate and then the ionizing agent in accordance with the present invention is coated.

The present invention is not limited to any of these methods, but in the case the ionizing agent is coated in advance on the substrate, the ionizing agent is not lost on evaporation or volatilization and, therefore, the efficacy of the ionizing agent can be demonstrated to the greatest extent.

In accordance with the present invention, well-known materials, for example, noble metals such as gold and platinum, metals such as stainless steel and aluminum, silicon, titanium oxide, and zinc oxide can be selected as a sample substrate for mass spectrometry. In particular, a noble metal such as platinum, and also stainless steel, titanium oxide, and zinc oxide can be advantageously used as the substrate to be coated in advance with the ionizing agent in accordance with the present invention because variation in electric properties caused by oxidation can be avoided. A substrate with a flat shape may be used. In particular, when a substrate with peaks and valleys with a difference in height between the deepest valley and the highest peak of from 10 nm to about 200 nm is used, the contact frequency of the measurement object molecule to be measured and the ionizing agent present on the substrate is increased. Accordingly such shape of the aforementioned materials may be used.

In accordance with the present invention, a matrix molecule can be used if necessary. Well-known conventional materials such as nitroanthracene (9NA) 44,2,5-dihydroxybenzoic acid (DHB), sinapinic acid, and α-cyanohydroxycinnamic acid (CHCA) can be used as the matrix molecule.

Well-known conventional solvents such as water, ethanol, methanol, propyl alcohol, tetrahydrofuran, acetonitrile, dimethylformamide, DMSO, benzene, toluene, dichloromethane, trichloromethane, acetone, and methyl ethyl ketone can be used as the solvent for preparing a sample for use in mass spectrometry, but taking into account the proton donating ability of the ionizing agent in accordance with the present invention, a polar solvent such as water may be contained. Furthermore, in order to avoid problems associated with handling of mass spectrometry samples, a solvent with a boiling point equal to or lower than 150° C., such as equal to or lower than 120° C., may be used.

In accordance with the present invention, gold ions or gold cluster ions, bismuth ions or bismuth cluster ions, fullerene ions, electrons, rare gases, ultraviolet laser, infrared laser, and visible light laser can be used as a primary beam selected from ions, neutral particles, electrons, and a laser beam.

Examples of the object substance to be measured for use in accordance with the present invention include proteins, modified proteins, peptides, modified peptides, sugars, lipids, glycoproteins, glycolipids, DNA, RNA, synthetic macromolecules, dyes, pigments, and additives.

EXAMPLES

Examples of the present invention will be described below in greater detail.

<Sample Substrate Example 1 for Mass Spectrometry>

A platinum oxide layer of a dendritic structure was formed to a thickness of 1000 nm by a reactive sputtering method on a mirror finished stainless steel (SUS 430, 30 mm×30 mm×t0.6 mm). The supported amount of Pt in this case was 0.27 mg/cm$^2$. The reactive sputtering was conducted under the following conditions: total pressure 4 Pa, oxygen flow rate ratio ($QO_2/(Q_{Ar}+Q_{O2})$) 70%, substrate temperature 80° C., power input 4.9 W/cm$^2$. Here $QO_2$ denotes an oxygen flow rate and $Q_{Ar}$ denotes an argon flow rate.

The platinum oxide of the dendritic structure was subjected to reduction for 30 min at 120° C. in a 2% $H_2$/He atmosphere (1 atm), and a substrate having a dendritic platinum nanostructure was obtained. The substrate was cut to 0.6 mm and adhesively fixed with a conductive two-side adhesive tape to a stainless steel target substrate for MALDI-TOF MS (Brucker Co.).

<Preparation Example 1 of Object Substance to be Measured>

A sample (MassPREP Peptides Mixture, Waters Co.) prepared by mixing peptides of nine types: RASG-1 (molecular weight Mw=1000.49), Angiotensin frag. 1-7 (Mw=898.47), bradykinin (Mw=1059.56), Angiotensin I (Mw=1295.68), Angiotensin II (Mw=1045.53), Renin substrate (Mw=1757.93), Enolase T35 (Mw=1871.96), Enolase T37 (Mw=2827.28), Melittin (Mw=2845.74) was used. The content of each peptide was about 1.0 nmol.

Water was added to the peptide mixture sample to obtain a concentration of each peptide of about 10 μmol/L. When 1 μL of the peptide solution was dropped and dried, a state was assumed in which the content of each peptide per 1 spot of the analyte sample was about 10 pmol.

Example 1

A 1 wt. % aqueous solution, 2 μL, of perfluorodicarboxylic acid (boiling point 150° C./5 mm Hg) having the below-described structural formula was dropped on a substrate produced in the Substrate Example 1 and dried.

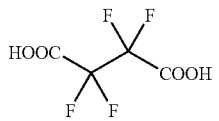

Then, 1 μL of the peptide solution prepared in Preparation Example 1 of object substance to be measured was dropped on the substrate and dried.

The substrate was mounted on a MALDI-TOF MS device (REFLEX-III™, manufactured by Brucker Daltonics Co.). An irradiation laser in the MALDI-TOF MS measurements was a nitrogen laser (wavelength=337 nm) and a positive ion reflector mode was used. The measurements were conducted at an irradiation laser intensity that is by 2% higher than the intensity at which a new ion peak is revealed, a spectrum of 20 pulses was integrated in one site, the spectra were integrated over 10 sites, and a spectrum was obtained in which signal intensities obtained from a total of 200 pulses of laser irradiation were added up.

An accelerating voltage was set to 26.5 kV and peaks from a mass number of 800 to 3000 were picked up.

Example 2

Sample preparation and mass spectrometry were carried out in the same manner as in Example 1, except that the ionizing agent was changed to a compound (boiling point equal to or higher than 150° C.) represented by the structural formula below.

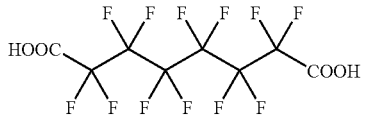

Comparative Example 1

Sample preparation and mass spectrometry were carried out in the same manner as in Example 1, except that the ionizing agent was changed to trifluoroacetic acid (boiling point 74° C.).

Mass spectra obtained in Examples 1 and 2 and Comparative Example 1 are shown in FIG. 1.

Comparison of the spectra obtained in Examples 1 and 2 and Comparative Example 1 demonstrates that using a mass spectrometry substrate obtained by coating a substrate with the ionizing agent in accordance with the present invention makes it possible to detect the analyte molecule to be measured with higher sensitivity.

Example 3

A sample (MassPREP Peptides Mixture, Waters Co.) in which nine peptides were mixed in the same manner as in Preparation Example 1 of analyte was dissolved in a 1 wt. % aqueous solution prepared by dissolving perfluorodicarboxylic acid (boiling point 150° C./5 mm Hg) represented by the following formula:

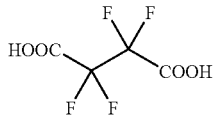

to prepare a solution with a concentration of each peptide of about 10 μmol/L. This peptide solution, 1 μL, was dropped on the substrate produced in Substrate Example 1 and dried.

The substrate was mounted on a MALDI-TOF MS device (REFLEX-III™, manufactured by Brucker Daltonics Co.). An irradiation laser in the MALDI-TOF MS measurements was a nitrogen laser (wavelength=337 nm) and a positive ion reflector mode was used. The measurements were conducted at an irradiation laser intensity that is by 2% higher than the intensity at which a new ion peak is revealed, a spectrum of 20 pulses was integrated in one site, the spectra were integrated over 10 sites, and a spectrum was obtained in which signal intensities obtained from a total of 200 pulses of laser irradiation were added up.

An accelerating voltage was set to 26.5 kV and peaks from a mass number of 700 to 3000 were picked up.

Example 4

Sample preparation and mass spectrometry were carried out in the same manner as in Example 3, except that the ionizing agent was changed to perfluorodicarboxylic acid (boiling point equal to or higher than 150° C.) represented by the structural formula below.

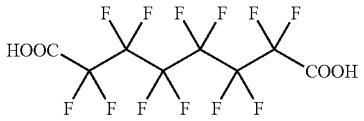

Comparative Example 2

Mass spectrometry was carried out in the same manner as in Example 3, except that trifluoroacetic acid was used as the ionizing agent.

Figure 2:
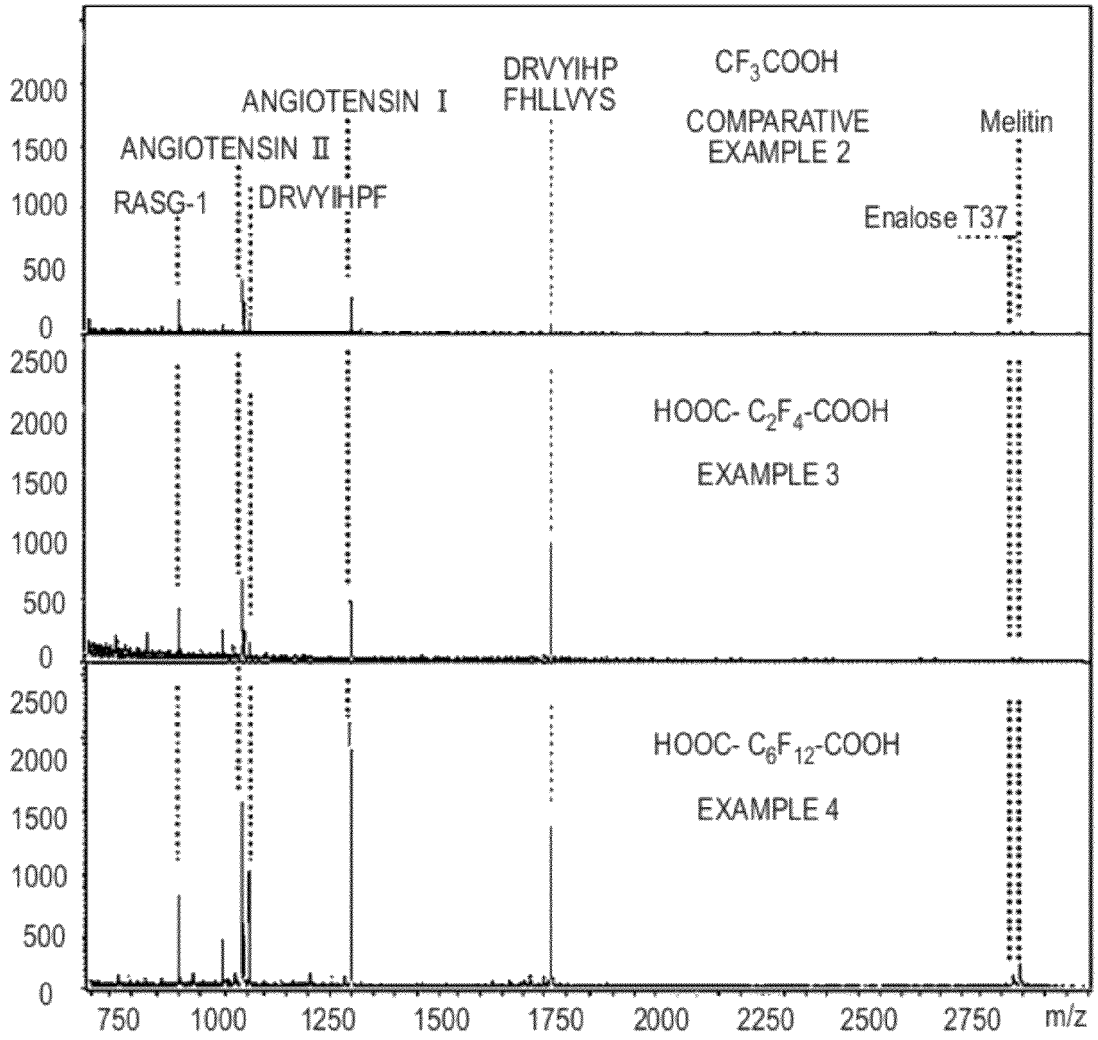
FIG. 2 illustrates mass spectrometry spectra of Examples 3 and 4 and Comparative Example 2.

Mass spectra obtained in Examples 3 and 4 and Comparative Example 2 are shown in FIG. 2.

Comparison of the spectra obtained in Examples 3 and 4 and Comparative Example 2 demonstrates that where measurements are conducted in a state in which the ionizing agent in accordance with the present invention is mixed with a measurement object, sample the ionizing agent in accordance with the present invention makes it possible to detect the object molecule to be measured with higher sensitivity.

Example 5

Mass spectrometry was carried out in the same manner as in Example 1, except that a substrate was used with a roughened surface obtained by immersing a mirror finished stainless steel (SUS 430, 30 mm×30 mm×t0.6 mm) for 20 min in concentrated hydrochloric acid (37 wt. %) and rinsing for 2 min.

Comparative Example 3

Mass spectrometry was carried out in the same manner as in Example 5, except that no ionizing agent was used.

Figure 3:
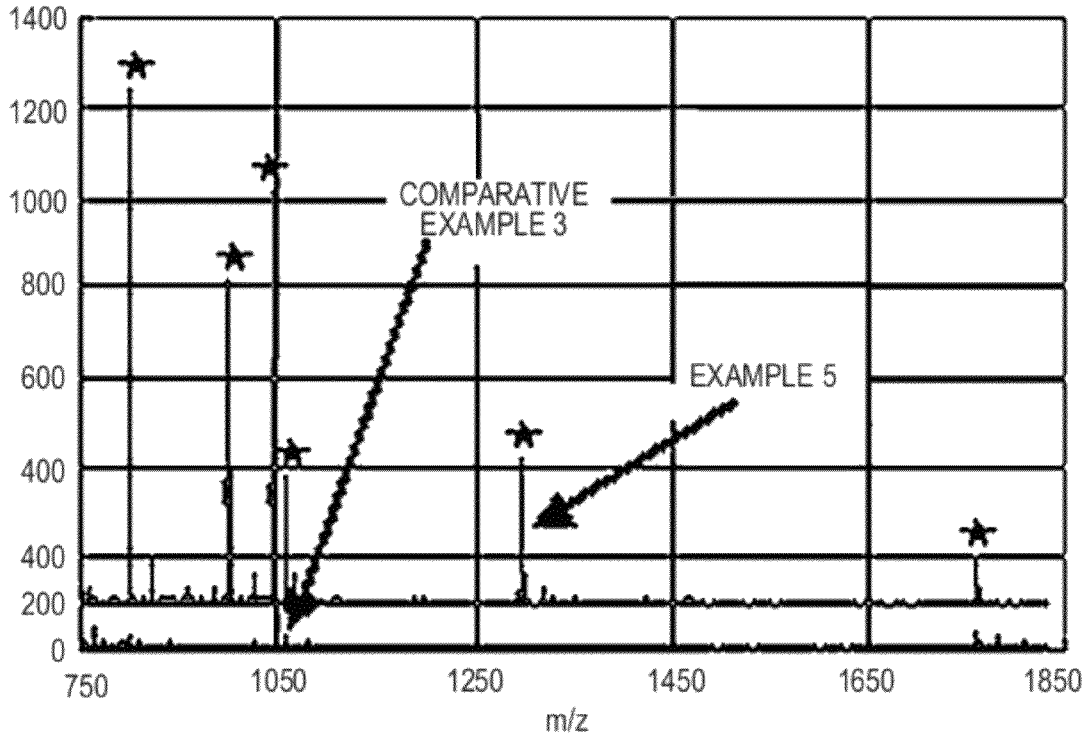
FIG. 3 illustrates mass spectrometry spectra of Example 5 and Comparative Example 3.

Mass spectra obtained in Example 5 and Comparative Example 3 are shown in FIG. 3.

Comparison of the spectra obtained in Example 5 and Comparative Example 3 demonstrates that the ionizing agent in accordance with the present invention makes it possible to detect the object molecule to be measured with very high sensitivity.

Example 6

Examination was conducted in the same manner as in Example 5, except that mass spectrometry was conducted by TOF-SIMS rather than by MALDI-TOF MS. The TOF-SIMS was conducted under the following conditions.

In the TOF-SIMS analysis, the measurements were conducted using a TOF-SIMS IV device manufactured by ION TOF Co. under the following conditions:

Primary ions: 25 kV Ga+, 2.4 pA (pulse current value) saw-tooth scan mode.

Primary ion pulse frequency: 3.3 kHz (300 μs/shot).

Primary ion pulse width: about 0.8 ns.

Primary ion beam diameter: about 3 μm.

Measurement region: 300 μm×300 μm.

Number of pixels of the secondary ion image: 128×128.

Integration time: about 400 sec.

Comparative Example 4

Mass spectrometry was conducted in the same manner as in Comparative Example 3, except that a TOF-SIMS method (measurement conditions identical to those of Example 6) was used.

Comparative Example 5

An attempt was made to prepare an aqueous solution of a monocarboxylic acid (boiling point 218° C.) having attached thereto a perfluoroalkyl chain and represented by the following structural formula as an ionizing agent, but the acid was difficult to dissolve. Therefore, mass spectrometry could not be conducted.

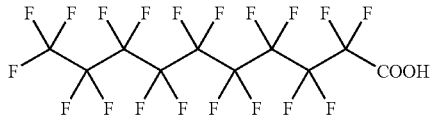

Comparison of the spectra obtained in Example 6 and Comparative Example 4 demonstrates that the ionizing agent in accordance with the present invention increased detection sensitivity of the object molecule to be measured.

Example 7

A mixed aqueous solution including Insulin (compositional formula: $C_{254}H_{377}N_{65}O_{75}S_6$, molecular weight 5773.49) and Insulin Chain B Oxidized (compositional formula: $C_{157}H_{232}N_{40}O_{47}S_2$, molecular weight 3495.89) at 2 μg/L each was prepared, perfluorodicarboxylic acid (boiling point equal to or higher than 150° C.) represented by the following structural formula

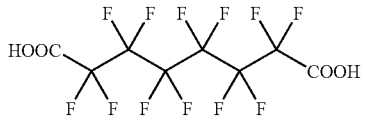

was added as an ionizing agent to obtain a content ratio thereof of 2 wt. % and a measurement sample solution was prepared. The solution, 0.1 μl, was dropped on a silicon wafer that has been vapor deposited with gold and dried under atmospheric pressure. Mass spectrometry was then conducted in the below-described measurement device.

In the TOF-SIMS analysis, the measurements were conducted using a TOF-SIMS 5 device manufactured by ION TOF Co. under the following conditions:

Primary ions: 25 kV Bi+, 0.3 pA (pulse current value) saw-tooth scan mode

Primary ion pulse frequency: 2.5 kHz (300 μs/shot).

Primary ion pulse width: about 0.8 ns.

Primary ion beam diameter: about 3 μm.

Measurement region: 300 μm×300 μm.

Number of pixels of the secondary ion image: 128×128.

Integration time: about 400 sec.

Comparative Example 6

Mass spectrometry was conducted in the same manner as in Comparative Example 7, except that trifluoroacetic acid served as an ionizing agent.

Figure 4:
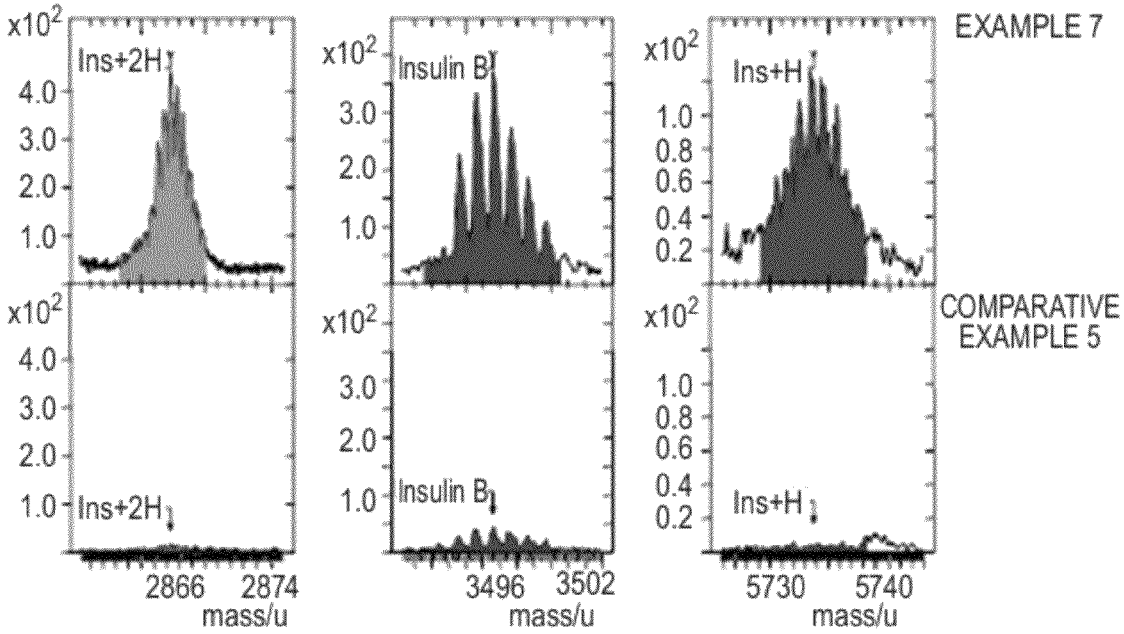
FIG. 4 illustrates mass spectrometry spectra of Example 7 and Comparative Example 5.

Spectra obtained in Example 7 and Comparative Example 5 are shown in FIG. 4. In Example 7, an Insulin monoproton adduct and diproton adduct and an Insulin Chain B Oxidized monocation were detected, whereas in Comparative Example 6 these peaks were extremely weak, thereby confirming the effect of the ionizing agent of Examples.

Reference examples confirming volatility of ionizing agents are shown in the reference examples.

Reference Example 1

A total of 3 μL of each aqueous solution of ionizing agent (the ionizing agent of Comparative Example 5 was a dispersion) used in Examples 1 and 2 and comparative Examples 1 and 5 were dropped on mirror-finished sample substrates (manufactured by Brucker Daltonics Co.) of MALDI-TOF MS and dried. The substrates were mounted on a mass spectrometer (REFLEX-III™, manufactured by Brucker Daltonics Co.) and allowed to stay for 30 min under a high-vacuum state ($2\times10^{-7}$ Torr) in the mass spectrometer. The substrates were then taken out, and the ionizing agents remaining on the substrate surface were checked under a microscope. The result obtained demonstrated that in Examples 1 and 2 and Comparative Example 5, the ionizing agents could be confirmed to be present on the substrate even after the device layer installation, whereas no traces of the ionizing agent used in Comparative Example 1 could be confirmed to be present.

Reference Example 2

Ionizing agents used in Examples 1 and 2 and Comparative Examples 1 and 5 were placed in quartz tubes with an inner diameter of 3 mm and the tubes were immersed for 30 min in an oil bath at 150° C. When the residual amount of each ionizing agent was then checked, no residue of the ionizing agent of Comparative Example 1 was found to be present.

The present invention makes it possible to detect a desorbed/ionized object substance to be measured with high sensitivity in mass spectrometry in which the object substance to be measured is desorbed and ionized. Therefore, the substrate in accordance with the present invention can be used as an ionization enhancer in mass spectrometry.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2008-114483 filed Apr. 24, 2008, which is hereby incorporated by reference herein in its entirety.

What is claimed is:

1. A substrate for use in mass spectrometry comprising an ionizing agent represented by General Formula (2) below:

$$HOOC—(CF_2)n\text{-}COOH \quad (2)$$

wherein n is an integer of equal to or greater than 2 and equal to or less than 7.

2. The substrate for mass spectrometry according to claim 1, wherein the ionizing agent does not absorb ultraviolet radiation with a wavelength equal to or greater than 330 nm and equal to or less than 370 nm.

3. The substrate for mass spectrometry according to claim 1, wherein the substrate for mass spectrometry is formed from a material selected from gold, platinum, stainless steel, titanium oxide, zinc oxide, tin oxide, and ITO.

4. The substrate for mass spectrometry according to claim 1, wherein the mass spectrometry is SIMS.

5. The substrate for mass spectrometry according to claim 1, wherein the primary beam is ions.

6. The substrate for use in mass spectrometry according to claim 1, wherein the substrate has peaks and valleys.

7. A mass spectrometry method comprising: placing at least an ionizing agent represented by General Formula (2) below:

$$HOOC—(CF_2)n\text{-}COOH \quad (2)$$

wherein n is an integer of equal to or greater than 2 and equal to or less than 7; and irradiating the ionizing agent and the molecule that is a measurement object with a primary beam selected from ions, neutral particles, electrons, and a laser beam.

8. The mass spectrometry method according to claim 7, wherein the ionizing agent does not absorb ultraviolet radiation with a wavelength equal to or greater than 330 nm and equal to or less than 370 nm.

9. A mass spectrometry method according to claim 7, wherein information relating to a distribution state of an object substance to be measured is obtained based on mass information acquired by changing an irradiation position of a primary beam selected from ions, neutral particles, electrons, and a laser beam on the ionizing agent and the analyte molecule.

10. The substrate for mass spectrometry according to claim 1, wherein n in General Formula (2) is an integer equal to or greater than 2 and equal to or less than 5.

11. A substrate for use in mass spectrometry comprising an ionizing agent having two or more functional groups represented by Formula (1) below in a molecule:

$$—(CF_2)COOH \quad (1)$$

wherein the ionizing agent has a boiling point of equal to or higher than 150° C.

12. The substrate according to claim 11, wherein the substrate has peaks and valleys.

13. The substrate for use in mass spectrometry according to claim 11 wherein the ionizing agent includes at least one compound selected from the group consisting of compounds represented by following formulas:

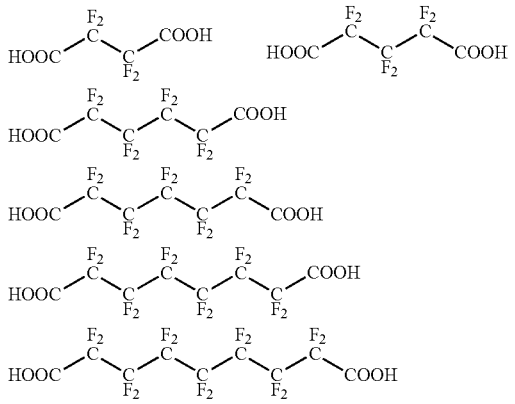

-continued

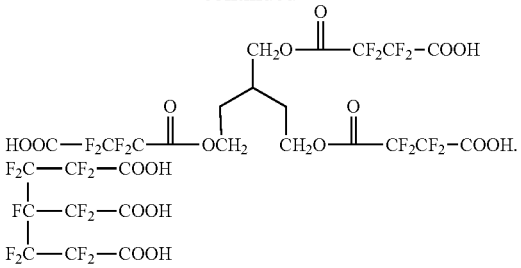

14. A mass spectrometry method comprising:

placing at least an ionizing agent having two or more functional groups represented by Formula (1) below in a molecule:

$$—(CF_2)COOH \quad (1)$$

wherein the ionizing agent has a boiling point of equal to or higher than 150° C. and a molecule that is a measurement object on a substrate; and irradiating the ionizing agent and the molecule that is a measurement object with a primary beam selected from ions, neutral particles, electrons, and a laser beam.

15. A mass spectrometry method according to claim 14, wherein the ionizing agent includes at least one compound selected from the group consisting of compounds represented by following formulas:

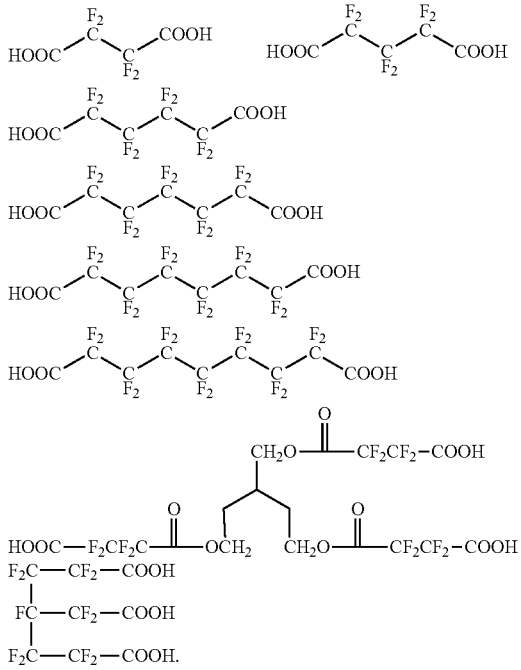

* * * * *